US009683709B2

(12) United States Patent
Lee et al.

(10) Patent No.: US 9,683,709 B2
(45) Date of Patent: Jun. 20, 2017

(54) LED LIGHTING APPARATUS

(71) Applicant: Seoul Semiconductor Co., Ltd., Ansan-si (KR)

(72) Inventors: Chung Hoon Lee, Ansan-si (KR); Dae Sung Cho, Ansan-si (KR); Sung Ho Jin, Ansan-si (KR); Ji Hye Ahn, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 39 days.

(21) Appl. No.: 14/363,179

(22) PCT Filed: Dec. 4, 2012

(86) PCT No.: PCT/KR2012/010416
§ 371 (c)(1),
(2) Date: Jun. 5, 2014

(87) PCT Pub. No.: WO2013/085244
PCT Pub. Date: Jun. 13, 2013

(65) Prior Publication Data

US 2014/0334148 A1 Nov. 13, 2014

(30) Foreign Application Priority Data

Dec. 6, 2011 (KR) ..... 10-2011-0129729

(51) Int. Cl.
*F21V 1/00* (2006.01)
*F21K 99/00* (2016.01)
(Continued)

(52) U.S. Cl.
CPC ..... *F21K 9/50* (2013.01); *F21S 8/085* (2013.01); *F21V 7/0016* (2013.01);
(Continued)

(58) Field of Classification Search
CPC ..... F21K 9/50; F21V 7/0016; F21V 29/76; F21V 19/004; F21V 29/004;
(Continued)

(56) References Cited

U.S. PATENT DOCUMENTS 6,250,774 B1 * 6/2001 Begemann ..... F21V 5/008 362/231
7,187,011 B2 3/2007 Tasch et al.
(Continued)

FOREIGN PATENT DOCUMENTS

CN 101619810 1/2010
CN 201437917 4/2010
(Continued)

OTHER PUBLICATIONS

Extended European Search Report issued on Jul. 13, 2015, in European Patent Application No. 12855619.8.
(Continued)

*Primary Examiner* — Andrew Coughlin
*Assistant Examiner* — Matthew Peerce
(74) *Attorney, Agent, or Firm* — H.C. Park & Associates, PLC

(57) ABSTRACT

An LED lighting apparatus is provided. The LED lighting apparatus comprises: an LED module; a heat dissipation member; and a connection member for connecting the LED module and the heat dissipation member mechanically and heat-conductively. The heat dissipation member comprises a reflective surface for reflecting light from the LED module.

18 Claims, 4 Drawing Sheets

(51) Int. Cl.

| | |
|---|---|
| ***F21S 8/08*** | (2006.01) |
| ***F21V 29/505*** | (2015.01) |
| ***F21V 7/00*** | (2006.01) |
| ***F21V 19/00*** | (2006.01) |
| ***F21V 29/76*** | (2015.01) |
| *F21W 131/103* | (2006.01) |
| *F21Y 101/00* | (2016.01) |
| *F21Y 105/10* | (2016.01) |
| *F21Y 115/10* | (2016.01) |
| *F21Y 107/00* | (2016.01) |

(52) U.S. Cl.
CPC ..... *F21V 19/004* (2013.01); *F21V 29/505* (2015.01); *F21V 29/76* (2015.01); *F21W 2131/103* (2013.01); *F21Y 2101/00* (2013.01); *F21Y 2105/10* (2016.08); *F21Y 2107/00* (2016.08); *F21Y 2115/10* (2016.08)

(58) Field of Classification Search
CPC ..... F21W 2111/02; F21W 2131/101; F21W 2131/103; F21Y 2101/02
USPC ..... 362/235, 218
See application file for complete search history.

(56) References Cited

U.S. PATENT DOCUMENTS

| | | | | |
|---|---|---|---|---|
| 8,556,466 | B2 * | 10/2013 | Shin | F21V 3/02 361/713 |
| 2004/0120160 | A1 | 6/2004 | Natsume | |
| 2010/0254128 | A1 * | 10/2010 | Pickard | F21V 7/0033 362/231 |
| 2010/0284181 | A1 * | 11/2010 | O'Brien | F21S 8/026 362/235 |
| 2010/0309662 | A1 * | 12/2010 | Zheng | F21V 29/004 362/235 |
| 2011/0026253 | A1 | 2/2011 | Gill | |
| 2011/0051420 | A1 | 3/2011 | Gill | |
| 2011/0280000 | A1 | 11/2011 | Kwak et al. | |
| 2011/0291569 | A1 | 12/2011 | Shin et al. | |
| 2012/0033419 | A1 * | 2/2012 | Kim | F21S 8/026 362/235 |
| 2012/0287618 | A1 * | 11/2012 | Saito | F21S 8/086 362/230 |
| 2013/0083516 | A1 * | 4/2013 | Yoon | F21V 29/004 362/190 |

FOREIGN PATENT DOCUMENTS

| | | |
|---|---|---|
| CN | 201599643 | 10/2010 |
| CN | 201916802 | 8/2011 |
| DE | 202009015012 | 1/2010 |
| EP | 1988336 | 11/2008 |
| EP | 2177820 | 4/2010 |
| EP | 2287520 | 2/2011 |
| JP | 2005149845 | 6/2005 |
| JP | 2007-300138 | 11/2007 |
| JP | 2010-108918 | 5/2010 |
| JP | 2011-044428 | 3/2011 |
| JP | 2011-100714 | 5/2011 |
| KR | 10-0949452 | 3/2010 |
| KR | 10-2010-0102577 | 9/2010 |
| KR | 10-2011-0031651 | 3/2011 |
| WO | 2011058387 | 5/2011 |

OTHER PUBLICATIONS

International Search Report dated Mar. 8, 2013 in International Patent Application No. PCT/KR2012/010416.
Written Opinion dated Mar. 8, 2013 in International Patent Application No. PCT/KR2012/010416.

* cited by examiner

LED LIGHTING APPARATUS

CROSS-REFERENCE TO RELATED APPLICATIONS

This application is the National Stage of International Application No. PCT/KR2012/010416, filed on Dec. 4, 2012, and claims priority from and the benefit of Korean Patent Application No. 10-2011-0129729, filed on Dec. 6, 2011, which are hereby incorporated by reference for all purposes as if fully set forth herein.

BACKGROUND

Field

The present invention relates to an LED lighting apparatus, and more particularly, to an LED lighting apparatus, such as a street light, a security light or a factory light, which requires good heat dissipation characteristic.

Discussion of the Background

A halogen lamp, a mercury-vapor lamp, a metal halide lamp, a sodium-vapor lamp or the like have been used for the light source of a high output lighting apparatus such as a street light, a security light or a factory light. Such lamps have low economic feasibility because high power consumption is caused by the low efficiency. In addition, there is a problem that the lifetime of the lamp and electronic ballast is shortened. Furthermore, since most of lamps include environmentally harmful substances such as mercury, the use thereof has been restricted.

Recently, Light Emitting Diodes (LEDs) have attracted attention as light sources to resolve the problems of existing lamps for a lighting apparatus. The LEDs have advantages of long life time and low power consumption, and are environment friendly by not using environmentally harmful substances, for example, mercury.

In order to apply the LEDs as a light source for a lighting apparatus which requires high light output, such as a street light, a security light or a factory light, an LED module in which a plurality of LEDs are integrated with high density is required. The LED module having high-density integrated LEDs generates high temperature heat upon operation of the LEDs. The high temperature heat reduces the light-emitting efficiency of the LEDs and shortens the lifetime thereof. In particular, the high output LED lighting apparatus such as a street light, a security light or a factory light requires high voltage power for the operation of the LEDs. As a result, the high temperature heat is generated, and thus, thermal stress on the LEDs leads to the degradation of characteristics and frequent breakdown, which have been pointed out as serious disadvantages.

In order to the above-described problems, an existing LED lighting apparatus includes a heat dissipation structure having good heat conductivity, such as a heat sink or a heat dissipation plate, in a part on which the LED module is mounted. However, due to limitations in the characteristics of a metal material of which the heat dissipation structure is formed, the thickness of the heat radiation structure may become larger excessively in order to satisfy required heat dissipation performance.

In addition, in an LED lighting apparatus for emitting light downwardly, such as a street light, a security light or a factory light, the ratio of direct light which is emitted from the LED and is straightly directed downwardly without passing through a reflective surface is high. The LED is characterized in that straightness is high, that is, an orientation angle is narrow, and, therefore, in the case of the LED lighting apparatus used to illuminate a predetermined area, it may be advantageous to increase the amount of light passing through a reflective surface. However, mounting a separate reflection member does not allow the lighting apparatus to be compact or slim and is economically disadvantageous.

Since the existing LED lighting apparatus is exposed to a harsh external environment including rain, snow, dust, etc., the LED module needs to be disassembled for the replacement, cleaning or repair of the LED module in the case of breakdown, irregular operation or heavy pollution. However, the existing LED lighting apparatus has a structure in which the LED module is directly connected to a heat dissipation structure having large volume, thus making the disassembly of the LED module difficult.

SUMMARY

An aspect of the present invention is directed to an LED lighting apparatus having good heat dissipation performance.

Another aspect of the present invention is directed to an LED lighting apparatus which has good heat dissipation performance and facilitates the attachment and detachment of an LED module.

Another aspect of the present invention is directed to an LED lighting apparatus which has good heat dissipation performance and includes a structure suitable to emit light downwardly from a high position like a street light, a security light or a factory light.

According to an aspect of the present invention, an LED lighting apparatus includes: an LED module; a heat dissipation member; and a connection member for connecting the LED module and the heat dissipation member mechanically and heat-conductively, wherein the heat dissipation member includes a reflective surface for reflecting light from the LED module.

According to one embodiment, the LED lighting apparatus may further include an upper cover and a transparent cover connected to the upper cover, wherein the LED module, the heat dissipation member, and the connection member may be disposed between the upper cover and the transparent cover.

According to one embodiment, the connection member may include a module mounting part to which the LED module is attached, and a main connection part connected to the heat dissipation member heat-conductively and mechanically may be formed at one end of the module mounting part.

According to one embodiment, a reinforcing connection part connected to a supporting part fixed to a part of the LED lighting apparatus may be formed at the other end of the module mounting part.

According to one embodiment, the module mounting part may include a first module mounting side directed toward the reflective surface and a second module mounting side 524 not directed toward the reflective surface. A first LED module may be mounted in the first module mounting side and emit light toward the reflective surface, and a second LED module may be mounted in the second module mounting side and emit light toward a direction having no reflective surface.

According to one embodiment, the first module mounting side and the second module mounting side may be directed to opposite directions to each other.

According to one embodiment, the first module mounting side and the second module mounting side may intersect with each other at a predetermined angle.

According to one embodiment, the first module mounting side and the second module mounting side may intersect with each other at an acute angle.

According to one embodiment, the main connection part may be formed to be elastically deformable.

According to one embodiment, the main connection part may be formed to have a hook shape.

According to one embodiment, the connection member may have an elastic deformable structure and define a gap between the connection member and the supporting part corresponding thereto, and the LED module may be inserted into and mounted in the gap while the connection member is elastically deformed.

According to one embodiment, the connection member may include an uneven pattern which increases an area coming into contact with the heat dissipation member.

According to one embodiment, the connection member may include an uneven pattern which increases an area coming into contact with air.

According to one embodiment, a plurality of air through-holes may be formed in the upper cover.

According to one embodiment, the LED module may include: a printed circuit board; a plurality of LED chips mounted directly on the printed circuit board; and a transparent encapsulating material which encapsulates the plurality of LED chips.

According to one embodiment, the LED module may further include a wavelength conversion layer formed directly on the Led chips.

According to one embodiment, the heat dissipation member may include a plurality of heat dissipation fins on the reflective surface.

According to one embodiment, the LED module may include a printed circuit board and a plurality of LEDs mounted on a chip mounting surface of the printed circuit board, and a surface opposite to the chip mounting surface of the printed circuit board may come into contact with air.

According to another aspect of the present invention, an LED lighting apparatus includes: a plurality of LED modules; a plurality of heat dissipation members provided corresponding to the LED modules; and a plurality of connection members for connecting the LED modules and the heat dissipation members, respectively, mechanically and heat-conductively, wherein each of the plurality of heat dissipation members includes a reflective surface for reflecting light from the corresponding LED module.

According to the present invention, an LED lighting apparatus having a simple structure and good heat dissipation performance can be implemented. In addition, according to the present invention, an LED lighting apparatus having good heat dissipation performance and facilitating the attachment and detachment of an LED module can be implemented. An LED lighting apparatus according to the present invention has good heat dissipation performance and includes a structure suitable to emit light downwardly from a high position like a street light, a security light or a factory light.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
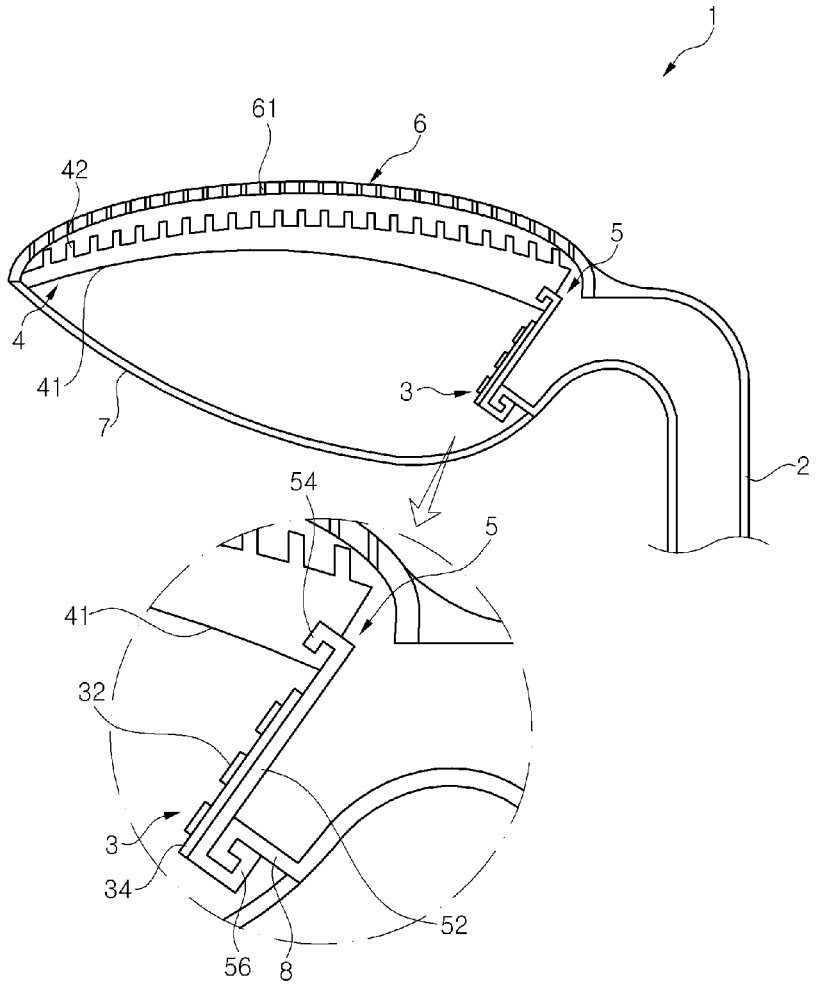
FIG. 1 is a cross-sectional diagram illustrating an LED lighting apparatus according to an embodiment of the present invention.

Hereinafter, preferred embodiments of the present invention will be described in detail with reference to the accompanying drawings. The following embodiments are provided only for illustrative purposes so that those skilled in the art can fully understand the spirit of the present invention. Therefore, the present invention is not limited to the following embodiments but may be implemented in other forms. In the drawings, the widths, lengths, thicknesses and the like of elements are exaggerated for convenience of illustration.

Like reference numerals indicate like elements throughout the specification and drawings. Throughout the specification, the terms indicating orientations are used to describe the positions, structures and arrangements of the respective elements according to the illustration in the drawings. Unless the terms are directly associated with the technical spirit of the invention, the invention should not be limited by these terms.

Figure 2:
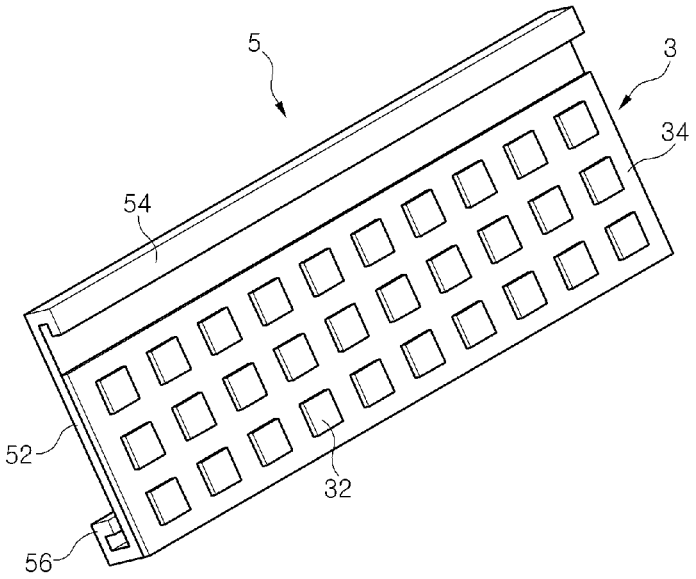
FIG. 2 is a perspective view illustrating an LED module and a connection member illustrated in FIG. 1.

FIG. 1 is a cross-sectional diagram illustrating an LED lighting apparatus according to an exemplary of the present invention and FIG. 2 is a perspective view illustrating an LED module and a connection member illustrated in FIG. 1.

Referring to FIG. 1, an LED lighting apparatus 1 according to an embodiment of the present invention includes a structure suitable for a street light and is mounted on the upper end of a support 2.

The LED lighting apparatus 1 includes an LED module 3, a heat dissipation member 4 for efficiently discharging heat generated by the LED module 3, and a connection member 5 for connecting the LED module 3 and the heat dissipation member 4 heat-conductively and mechanically.

The LED lighting apparatus 1 includes an upper cover 6 connected to an upper end of the support 2 and a light-transparent lower cover 7 (hereinafter referred to as an "optical cover") which covers the lower part of the upper cover 6. The LED module 3, the heat dissipation member 4, and the connection member 5, which have been described above, are located in a space between the upper cover 6 and the lower optical cover 7.

The upper cover 6 may have a bow-shaped, shell-shaped or arc-shaped cross-section and has a uniform thickness. A plurality of air through-holes 61 are formed in the upper cover 6 to pass through the upper cover 6 in a thickness direction. Convection circulation occurs between heated air within the closed space and cold air outside the closed space, thus contributing to improvement of the heat dissipation performance of the LED module 3.

The heat dissipation member 4 is connected to the LED module 3 heat-conductively by the connection member 5 and includes a reflective surface 41 for reflecting light emitted from the LEDs of the LED module 3 in the lower part thereof, thereby performing the function of a reflecting member.

The heat dissipation member 4 is located at the lower part of the upper cover 6 and may have a bow-shaped, shell-shaped or arc-shaped cross-section which is very similar to the upper cover 6. A concave reflective surface 41 is arranged in the lower part of the heat dissipation member 4, and a plurality of heat dissipation fins 42 may be formed in the upper side of the heat dissipation member 4. The heat dissipation fins 42 may be formed in a linear structure having a length when viewed from the top, or have a needle or rod shape. In this embodiment, the heat dissipation fins 42 are totally located under the upper cover 6, but it can be considered that the tips of the heat dissipation fins 42 are formed to be thin and the tips are exposed to outside through the air through-hole 61.

A connection device may be mounted to connect the heat dissipation member 4 and the upper cover 6 to be spaced apart from each other. The dissipation member 4 is formed of a metal material having high heat conductivity. The heat dissipation member 4 may include a reflective layer formed of a material different from the metal material of which the heat dissipation member is formed in order to improve the reflectance of the reflective surface 41. However, if the metal surface of the heat dissipation member 4 has a sufficient reflectance, the reflective layer can be omitted.

The LED module 3 includes a plurality of LEDs 32 which emit light toward the lower reflective surface 41 of the heat dissipation member 4 and a printed circuit board 34 on which the plurality of LEDs 32 are mounted.

The LED 32 has a structure in which one or more LED chips are received in a cavity of a reflector or a housing, and each of the LED chips is encapsulated by a transparent encapsulating material filled within the cavity or a structure in which one or more LED chips are mounted in a flat substrate formed of, for example, a ceramic material, and each of the LED chips is encapsulated by a transparent encapsulating material molded on the flat substrate, and, further, may be a chip-on-board type LED in which an LED chip is mounted directly on a printed circuit board 34 and the LED chip is encapsulated by a transparent encapsulating material formed on the printed circuit board 34. The LED 32 may be formed of a wavelength conversion material such as a phosphor, and the wavelength conversion material may be directly formed on the LED chip by, for example, conformal coating or be included in the encapsulating material.

A Metal Core Printed Circuit Board (MCPCB) including a metal substrate having good heat conductivity in order to increase heat dissipation performance is preferred as the printed circuit board 34. The MCPCB may include an insulating material which insulates a metal substrate and a conductive pattern and insulates between the metal substrate and the conductive pattern. In this embodiment, the LED module is arranged such that the LEDs 32 are disposed to be inclined to direct toward the reflective surface 41.

As described above, the LED module 3 is connected to the heat dissipation member 4 by the connection member 5 heat-conductively and mechanically. The connection member 5 may be formed of a metal material having good heat conductivity. The connection member 5 and the heat dissipation member 4 may be an identical material or different materials.

Referring to FIGS. 1 and 2, the connection member 5 includes a plate type module mounting part 52 having a flat side. The LED module 3 is mounted on the upper side of the module mounting part 52. The lower side of the printed circuit board 34 of the LED module 3 may be attached to the upper side of the module mounting part 52. A hook type main connection part 54 is formed at one end of the module mounting part 52 and an engagement groove is formed at the heat dissipation member 4 so as to be engaged with the hook shaped part of the main connection part 54. The main connection part 54 is engaged with the engagement groove, so that the LED module 3 is connected to the heat dissipation member 4 through the connection member 5 mechanically and heat-conductively.

Meanwhile, the main connection part 54 is preferably formed to be elastically deformable. The engagement between the main connection part 54 and the engagement groove can be easily released by an operator or a user, and the LED module 3 can be easily separated from the heat dissipation member 4 through the release of the engagement.

In addition, a hook type sub connection part 56 is formed at the other end of the module mounting part 52, and a reinforcing support part 8 including an engagement-shaped part engaged with the hook-shaped part of the sub connection part is formed at a part of the lighting apparatus. The reinforcing support part 8 may be formed at the support 2, the heat dissipation member or the upper cover. The LED module 3 can be fixed more reliably and concretely by the engagement between the sub connection part 56 and the reinforcing support part 8. In a case where the sub connection part 56 and the reinforcing support part 8 are further used, the LED module 3 connected to the connection member 5 can be separated from the heat dissipation member 4 by the release of the engagement between the main connection part 54 and the engagement groove and the release of the engagement between the sub connection part 56 and the engagement-shaped part of the reinforcing support part 8. It is preferred that the sub connection part 56 have also a hook structure which is elastically deformable.

The hook shape of the main connection part 54 and the sub connection part 56 may be changed or modified variously, and it is sufficient if the shape facilitates engagement or the release of engagement through elastic deformation and restoration.

The module mounting part 52 has generally a rectangular plate shape, and the printed circuit board 34 of the LED module has a rectangle approximately corresponding to the module mounting part 52. The plurality of LEDs 32 is arranged in a matrix arrangement including a plurality of rows and a plurality of columns on the printed circuit board 34.

Figure 3:
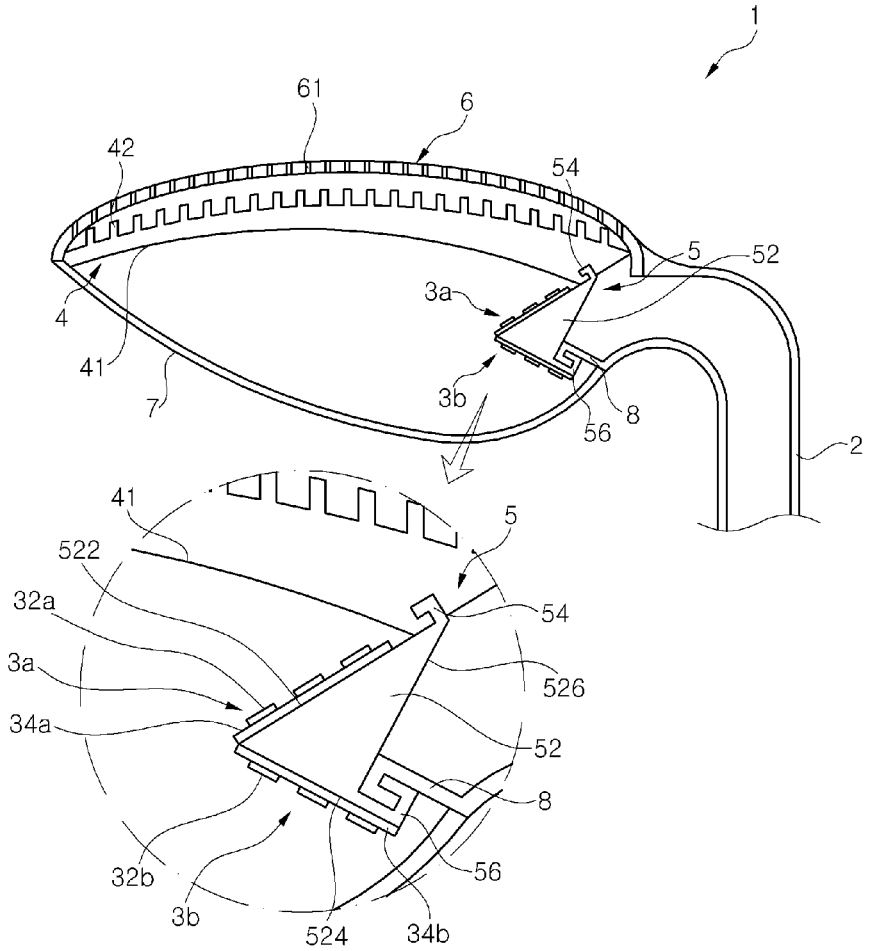
FIG. 3 is a cross-sectional view illustrating an LED lighting apparatus according to another embodiment of the present invention.
Figure 4:
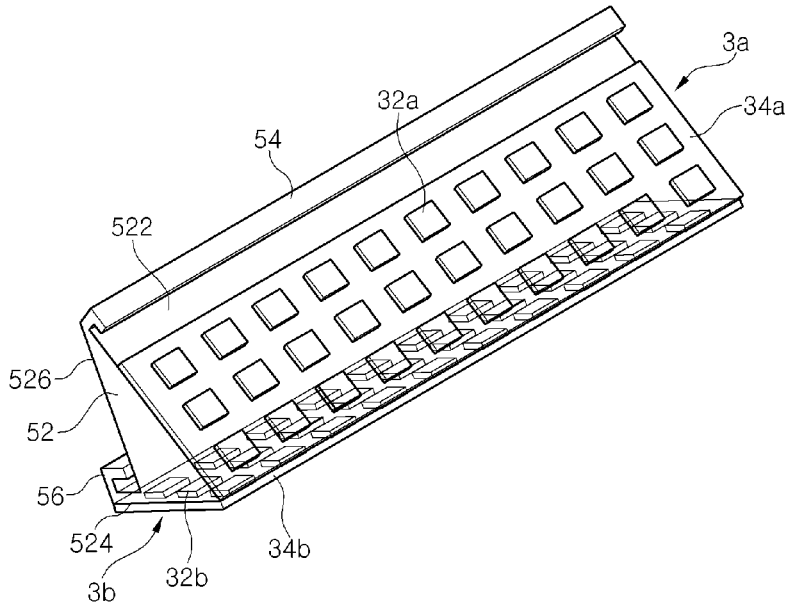
FIG. 4 is a perspective view illustrating an LED module and a connection member illustrated in FIG. 3.

FIG. 3 is a cross-sectional view illustrating an LED lighting apparatus according to another embodiment of the present invention, and FIG. 4 is a perspective view illustrating an LED module and a connection member illustrated in FIG. 3.

Referring to FIGS. 3 and 4, a connection member 5 includes a module mounting part 52 having approximately a triangle cross-section. The module mounting part 52 includes a first module mounting side 522 directed toward the reflective surface of the heat dissipation member 4 and a second module mounting side 524 intersecting with the first module mounting side 522 at an acute angle. The connection member 5 includes a base side 526 formed so as to intersect with both the first module mounting side 522 and second module mounting side 524.

A first LED module 3*a* is mounted on the first module mounting side 522, and the first module mounting side 522 and a printed circuit board 34*a* attached thereto are disposed at an angle such that the LEDs 32*a* of the first LED module 3*a* are directed toward the reflective side 41 of the heat dissipation member 4. A second LED module 3*b* is mounted on the second module mounting side 524.

It is difficult for light emitted from the LEDs 32*a* of the first LED module 3*a* and reflected by the reflective side 41 to arrive at a lower area close to the support 2. The printed circuit board 34*b* and LEDs 32*b* mounted therein of the second LED module 3*b* are directed toward the lower area close to the support 2, and are suitable to light the area which is not lightened by light from the above-described first LED module 3*a* and the reflective side 41. When the angle of the second module mounting side 524 with respect to the first module mounting side 522 is designed appropriately so as to be different, it is possible to control an area lighted by the second LED module 3*b*.

The base side 526 is a part disposed most close to the support 2, and includes a hook type main connection part 54 at the upper end of the base side 526. An engagement groove is formed at the heat dissipation member 4 so as to be engaged with the hook-shaped part of the main connection part 54. The main connection part 54 is engaged with the engagement groove, so that the first and second modules 3*a* and 3*b* are connected to the heat dissipation member 4 by the connection member 5 mechanically and heat-conductively.

Meanwhile, the main connection part 54 is preferably formed so as to be deformable elastically. The engagement between the main connection part 54 and the engagement groove can be easily released by an operator or a user, and the first and second LED modules 3*a* and 3*b* attached to the connection member 5 are easily separated from the heat dissipation member 4 by the release of the engagement.

In addition, a hook type sub connection part 56 is formed at the lower end of the base plane 526, and a reinforcing support part 8 including an engagement-shaped part engaged with the hook shaped part of the sub connection part is formed at a part of the lighting apparatus. The reinforcing support part 8 may be formed at the support 2, the heat dissipation member or the upper cover. The first and second LED modules 3*a* and 3*b* can be fixed more reliably and concretely by the engagement between the sub connection part 56 and the reinforcing support part 8. In a case where the sub connection part 56 and the reinforcing support part 8 are further used, the first and second LED modules 3*a* and 3*b* can be separated from the heat dissipation member 4 by the release of the engagement between the main connection part 54 and the engagement groove and the release of the engagement between the sub connection part 56 and the engagement-shaped part of the reinforcing support part 8. The sub connection part 56 is also preferred to have a hook structure which is deformable elastically.

Figure 5:
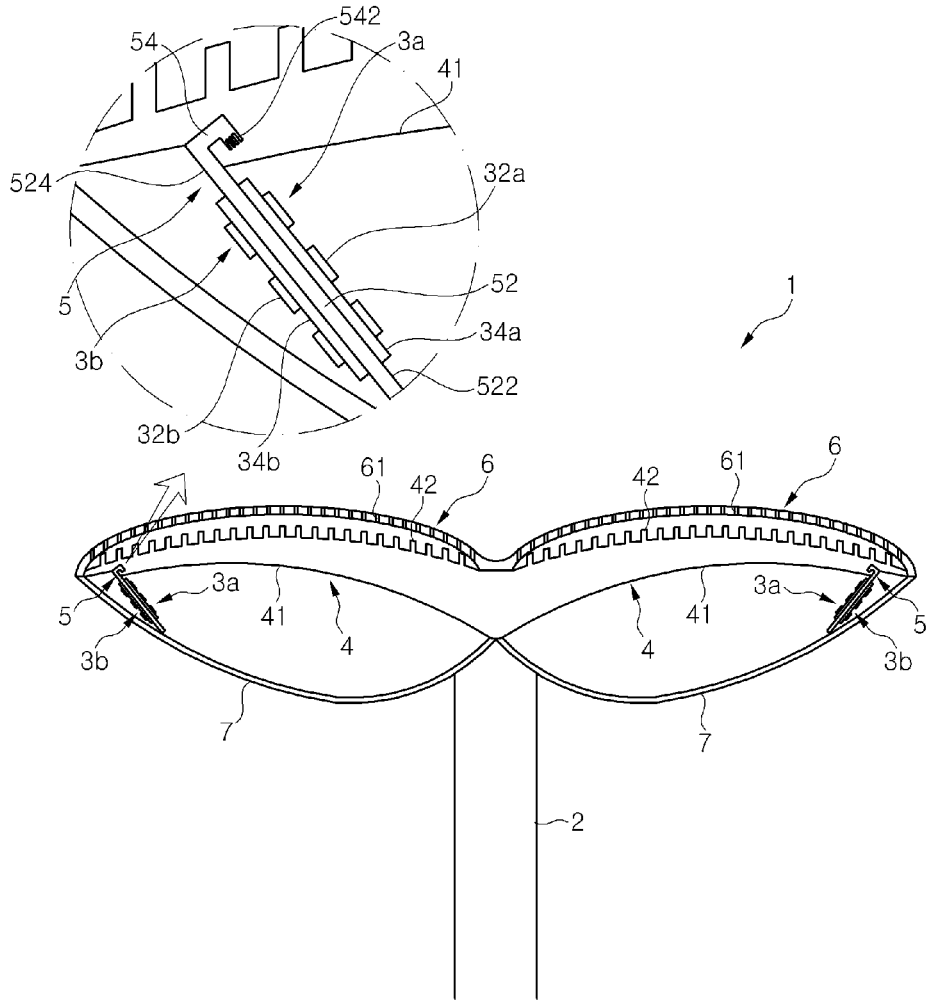
FIG. 5 is a cross-sectional view illustrating an LED lighting apparatus according to another embodiment of the present invention.

FIG. 5 is a cross-sectional view illustrating an LED lighting apparatus according to another embodiment of the present invention.

Referring to FIG. 5, an LED lighting apparatus 1 according to the embodiment includes a pair of dissipation members 4 and a pair of connection members 5. In FIG. 5, it is illustrated that the pair of dissipation members 4 are integrally connected to each other, but they may be separable from each other. A first LED module 3*a* and a second LED module 3*b* are mounted on the pair of connection members 5 respectively. Each of the pair of dissipation members 4 includes a reflective surface 41 for reflecting light from the first LED module 3*a* on the lower part thereof. Each of the pair of dissipation members 4 has heat dissipation fins 42 integrally formed on the upper side thereof.

The lighting apparatus 1 according to the embodiment includes a pair of upper covers 6 and a pair of optical covers 7 in order to accommodate the pair of connection members 5 and the LED modules attached to the connection members 5 and 5. The pair of upper covers 6 may be separated from each other and may be integrally formed. Similarly, the pair of optical covers 7 may be separated from each other and may be integrally formed.

The pair of connection members 5 connect the LED modules 3*a* and 3*b* and the heat dissipation members 4, respectively, in order to efficiently discharge heat generated by the LED modules 3*a* and 3*b* attached thereto heat-conductively and mechanically. Each of the pair of dissipation members 4 includes a reflective surface 41 for reflecting light reflected by the first LED module 3*a* directed toward itself among the first and second LED modules 3*a* and 3*b* attached to the connection members 5 and 5 on the lower part thereof.

The pair of heat dissipation members 4 are arranged to be symmetrical with respect to the support 2, and may have a bow-shaped, shell-shaped or arc-shaped cross-section. The reflective surfaces 41 and 41 which are provided at the lower parts of the pair of heat dissipation members 4 and 4 respectively are preferably formed to be concave. A plurality of heat dissipation fins 42 are formed on the upper side of the pair of heat dissipation members 4 and 4 respectively.

The connection members 5 and 5 are respectively connected to the front end of the heat dissipation members 4 and 4 to be inclined. Each of the connection members 5 includes a plate-type module mounting part 52. Due to the inclined arrangement, the module mounting part 52 includes a flat first module mounting side 522 which is directed toward the reflective surface 41 of the heat dissipation member 4 while being inclined, and a flat second module mounting side 524 directed downwardly while being inclined. The first LED module 32*a* is mounted on the first module mounting side 522 and the second LED module 32*b* is mounted on the second module mounting side 524.

A hook-type main connection part 54 is formed at one end of the module mounting part 52 and an engagement groove is formed at the heat dissipation member 4 to be engaged with the hook shaped part of the main connection part 54. The main connection part 54 is engaged with the engagement groove, so that the first LED module 3*a* and the second LED module 3*b* are connected to the pair of heat dissipation members 4 heat-conductively and mechanically while respectively being mounted on the pair of connection member 5. The main connection part 54 includes an uneven pattern 542 as a surface enlargement pattern at a part connected to the corresponding heat dissipation part 4. Due to the surface enlargement pattern or the uneven pattern 542, the surface area of the connection member 5 coming into contact with the heat dissipation member 4 is increased, thus contributing to improvement of heat dissipation performance.

Meanwhile, the main connection part 54 is preferably formed so as to be elastically deformable. The engagement between the main connection part 54 and the engagement groove can be easily released. Due to the release of the engagement, the first and second LED modules 3*a* and 3*b* can be easily separated from the heat dissipation member 4.

Figure 6:
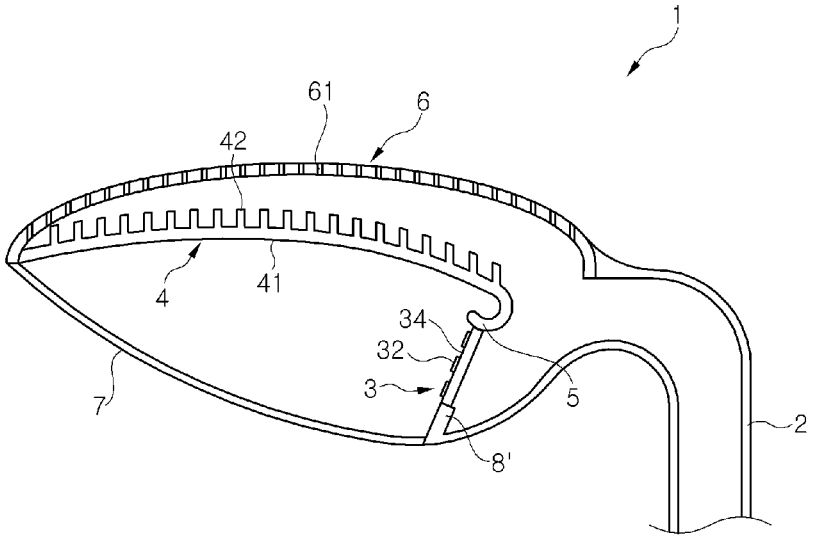
FIG. 6 is a cross-sectional view illustrating an LED lighting apparatus according to another embodiment of the present invention.

FIG. 6 is a cross-sectional view illustrating an LED lighting apparatus according to another embodiment of the present invention.

Referring to FIG. 6, the LED lighting apparatus 1 according to the embodiment includes an LED module 3, a heat dissipation member 4 for efficiently discharging heat generated by the LED module 3, and a connection member 5 for connecting the LED module 3 and the heat dissipation member 4 heat-conductively and mechanically as in the above-described embodiments. The LED lighting apparatus 1 includes an upper cover 6 connected to the upper end of the support 2 and an optical cover 7 which covers the lower part of the upper cover 6. The LED module 3, the heat dissipation member 4 and the connection member 5, which have been described above, are located in a space between the upper cover 6 and the lower optical cover 7.

The upper cover 6 may have a bow-shaped, shell-shaped or arc-shaped cross-section and has a uniform thickness. A plurality of air through-holes 61 are formed in the upper cover 6 to pass through the upper cover 6 in a thickness direction. Convection circulation occurs between heated air within the closed space and cold air outside the closed space, thus contributing to improvement of the heat dissipation performance of the LED module 3.

In this embodiment, the heat dissipation member 4 and the connection member 5 are integrally formed, and the connection member 5 is bent in a hook shape at the rear end of the heat dissipation member 4. The connection member 5 is defined as a part which is bent as describe above and maintained to be spaced apart from the lower side of the heat dissipation member 4. The connection member 5 can be elastically deformed in a direction closer to the lower side of the heat dissipation member 4 by a force pressed upwardly, and be elastically restored in a direction away from the lower side of the heat dissipation member 4 by the removal of the pressed force.

A supporting part 8' mounted at the support 2 is disposed at the lower part of the connection member 5, and a gap which allows the mounting of the LED module 3 exists between the connection member 5 and the supporting part 8'. The gap can be changed according to the elastic deformation of the connection member 5 and has a width smaller than that of the LED module 3 when there is no elastic deformation. The supporting part 8' may be mounted at another part of the LED lighting apparatus besides the support 2, and the supporting part 8' may include a structure which is elastically deformable.

The LED module 3 is inserted into and mounted in a gap between the connection member 5 and the supporting part 8' while accompanying the elastic deformation of the connection member 5. When the LED module 3 is mounted, the connection member 5 is integrally connected to the heat dissipation member 4, so that heat generated by the LED module 3 is well delivered to the heat dissipation member 4 through heat-conductivity. As described above, the LED module 3 is connected to the heat dissipation member 4 by the connection member 5 and the supporting part 8' mechanically and heat-conductively.

Pulling out the LED module 3 from the gap in a direction opposite to the insertion direction accompanies elastic restoration. As a result, the LED module 3 is easily separated from the heat dissipation member 4.

Similarly to the above-describe embodiment, the LED module 3 includes a plurality of LEDs 32 each emitting light toward the lower reflective surface 41 of the heat dissipation member 4 and a printed circuit board 34 in which the plurality of LEDs 32 is mounted. The printed circuit board 34 comes into contact with air at a side opposite to the side in which LEDs 32 are mounted. The rear of the LED module 3 and, further, the rear of the printed circuit board 34 are adjacent to an air through path expending into the upper part of the heat dissipation ember 4 and/or the hollow of the support 2, thereby improving heat dissipation performance by convection current. The connection member 5 may further include an uneven pattern (not illustrated) as a surface enlargement pattern which increases a surface area coming into contact with air.

Figure 7:
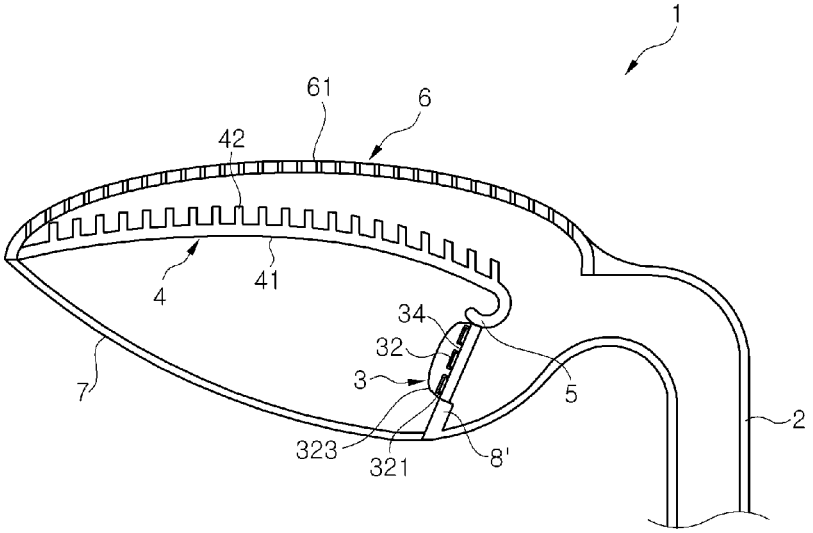
FIG. 7 is a cross-sectional view illustrating a lighting apparatus according to another embodiment of the present invention.

FIG. 7 is a cross-sectional view illustrating a lighting apparatus according to another embodiment of the present invention.

Referring to FIG. 7, an LED module 3 is formed by mounting a plurality of chip-level LEDs 32, that is, the LED chips 32 directly on a printed circuit board 34. Each of the plurality of LEDs 32 includes a wavelength conversion layer 321 formed directly by conformal coating. A transparent encapsulating material 323 is formed directly on the printed circuit board 34 so as to encapsulate the chip-level LEDs 32 each having the wavelength conversion layer 321. The transparent encapsulating material 323 may include one or more lens parts, and the lens parts can direct light emitted by the one or more chip-level LEDs 32 toward the reflective surface 41 of the heat dissipation member 4 appropriately. As described above, one including a metal substrate such as MCPCB may be used for the printed circuit board 34.

A wavelength conversion material such as a phosphor may be applied to the inside of the encapsulating material 323, external surfaces, the reflective surface 41 of the heat dissipation member 4, and the optical cover 7, instead of the direct formation of the wavelength conversion layer 321 on the chip-level LED 32. In this case, the wavelength conversion layer 321 directly formed on the chip-level LED 32 may be omitted. Although not illustrated, lens such as light collecting lens may be further mounted at any position on a path through which light emitted by the LED module 321 is directed toward the reflective surface 41, preferably between the LED module 3 and the reflective surface 41, more preferably on the reflective surface 41. In this case, the lens may be disposed at an area at which the most amount of light arrives.

Although not illustrated, a plurality of projections for inducing diffused reflection of light may be formed on the reflective surface 41 of the heat dissipation member 4.

While the present invention has been described with respect to the specific embodiments, it will be apparent to those skilled in the art that various changes and modifications may be made without departing from the spirit and scope of the invention as defined in the following claims.

The invention claimed is:

1. A light-emitting diode (LED) lighting apparatus comprising:

an LED module;

a heat dissipation member; and a connection member mechanically and thermally connecting the LED module and the heat dissipation member, wherein the heat dissipation member comprises a reflective surface for reflecting light emitted from the LED module;

wherein the LED module comprises:

a printed circuit board;

LED chips disposed directly on the printed circuit board; and a wavelength conversion layer disposed directly on the LED chips by conformal coating; and wherein the connection member is connected at a first distal end thereof to the heat dissipation member and connected at a second distal end thereof to a reinforcing support part, the first and second distal ends extending away from each other in relation to an extending plane of the connection member, each of the first and second distal ends comprising a hook shape.

2. The LED lighting apparatus of claim 1, further comprising an upper cover and a transparent cover connected to the upper cover, wherein the LED module, the heat dissipation member, and the connection member are disposed between the upper cover and the transparent cover.

3. The LED lighting apparatus of claim 2, wherein the connection member comprises:

a module mounting part to which the LED module is connected; and a main connection part mechanically and thermally connected to the heat dissipation member, the main connection part being disposed at the first distal end of the module mounting part.

4. The LED lighting apparatus of claim 3, wherein the connection member further comprises a reinforcing connection part connected to the reinforcing support part that is fixed to a part of the LED lighting apparatus, the reinforcing connection part being disposed at the second distal end of the module mounting part.

5. The LED lighting apparatus of claim 2, wherein a plurality of air through-holes are formed in the upper cover.

6. The LED lighting apparatus of claim 3, wherein the module mounting part comprises a first module mounting side directed toward the reflective surface and a second module mounting side not directed toward the reflective surface, a first LED module is disposed in the first module mounting side and is configured to emit light toward the reflective surface, and a second LED module is disposed in the second module mounting side and is configured to emit light toward a direction having no reflective surface.

7. The LED lighting apparatus of claim 6, wherein the first module mounting side and the second module mounting side are directed to opposite directions from each other.

8. The LED lighting apparatus of claim 6, wherein the first module mounting side and the second module mounting side intersect with each other.

9. The LED lighting apparatus of claim 8, wherein the first module mounting side and the second module mounting side intersect with each other at an acute angle.

10. The LED lighting apparatus of claim 3, wherein the main connection part is elastically deformable.

11. The LED lighting apparatus of claim 1, wherein:

the connection member comprises an elastic deformable structure and defines a gap between the connection member and a supporting part corresponding thereto; and the LED module is inserted into and disposed in the gap while the connection member is elastically deformed.

12. The LED lighting apparatus of claim 11, wherein the connection member comprises an uneven pattern which increases an area coming into contact with air.

13. The LED lighting of claim 11, wherein the connection member is integrally formed at one end of the heat dissipation member.

14. The LED lighting apparatus of claim 1, wherein the connection member comprises an uneven pattern which increases an area coming into contact with the heat dissipation member.

15. The LED lighting apparatus of claim 1, wherein the LED module further comprises:

a transparent encapsulating material encapsulating the LED chips.

16. The LED lighting apparatus of claim 1, wherein the heat dissipation member comprises heat dissipation fins on the reflective surface.

17. The LED lighting apparatus of claim 1, wherein the LED module comprises a printed circuit board and a plurality of LEDs disposed on a chip mounting surface of the printed circuit board, and a surface opposite to the chip mounting surface of the printed circuit board comes into contact with air.

18. A light-emitting diode (LED) lighting apparatus, comprising:

LED modules;

heat dissipation members disposed corresponding to the LED modules; and connection members thermally and mechanically connecting the LED modules and the heat dissipation members, respectively, wherein each of the heat dissipation members comprises a reflective surface for reflecting light emitted from the corresponding LED module;

wherein each of the LED modules comprises:

a printed circuit board;

LED chips disposed directly on the printed circuit board; and a wavelength conversion layer disposed directly on the LED chips by conformal coating; and wherein the connection members are respectively connected at a first distal end thereof to the heat dissipation members and connected at a second distal end thereof to a reinforcing support part, the first and second distal ends extending away from each other in relation to an extending plane of the connection members, respectively, each of the first and second distal ends comprising a hook shape.

* * * * *